United States Patent [19]

Kondo et al.

[11] Patent Number: 5,060,612

[45] Date of Patent: Oct. 29, 1991

[54] FUEL CONTROL APPARATUS FOR AN INTERNAL COMBUSTION ENGINE

[75] Inventors: Katsuhiko Kondo; Yasuhiko Ishida, both of Himeji, Japan

[73] Assignee: Mitsubishi Denki Kabushiki Kaisha, Tokyo, Japan

[21] Appl. No.: 637,836

[22] Filed: Jan. 7, 1991

[30] Foreign Application Priority Data

Feb. 6, 1990 [JP] Japan ..... 1-26610

[51] Int. Cl.[5] ..... F02D 31/00

[52] U.S. Cl. ..... 123/357; 123/494; 123/488; 73/118.2

[58] Field of Search ..... 123/494, 357, 358, 359, 123/488; 73/118.2

[56] References Cited

U.S. PATENT DOCUMENTS

| | | | |
|---|---|---|---|
| 4,593,667 | 6/1986 | Sasaki | 123/488 |
| 4,633,839 | 1/1987 | Yasuoka | 123/488 |
| 4,807,581 | 6/1989 | Nishikawa et al. . | |
| 4,860,222 | 8/1989 | Schmidt | 73/118.2 |
| 4,870,937 | 10/1989 | Sanbuichi | 123/488 |
| 4,873,641 | 10/1989 | Nagaishi | 123/494 |
| 4,957,088 | 9/1990 | Hosaka | 123/488 |
| 4,974,563 | 12/1990 | Ikeda | 123/494 |
| 4,986,244 | 1/1991 | Kobayashi | 123/488 |
| 4,996,959 | 3/1991 | Akimoto | 73/118.2 |

FOREIGN PATENT DOCUMENTS

| | | | |
|---|---|---|---|
| 0151736 | 6/1989 | Japan | 123/357 |

*Primary Examiner*—Carl Stuart Miller

*Attorney, Agent, or Firm*—Sughrue, Mion, Zinn, Macpeak and Seas

[57] ABSTRACT

A fuel control apparatus for an internal combustion engine comprises an intake air quantity detecting means for detecting an intake air quantity for the engine, a crank angle detecting means for detecting a crank angle of the engine, a sampling means for sampling the intake air quantity every predetermined time, a first calculating manes for calculating the means value of the sampled values every predetermined crank angle, a switching means for changing the crank angle value in accordance with the revolution speed of the engine, and a second calculating means for calculating a fuel injection quantity on the basis of the calculated means value, and a fuel injection means for injecting fuel to the engine at the fuel injection quantity obtained by the calculation.

1 Claim, 3 Drawing Sheets

FUEL CONTROL APPARATUS FOR AN INTERNAL COMBUSTION ENGINE

BACKGROUND OF THE INVENTION

1. Field of the Invention

The present invention relates to a fuel control apparatus for an internal combustion engine.

2. Discussion of Background

FIG. 1 shows schematically the construction of an electronic control device for an internal combustion engine. In FIG. 1, a reference numeral 1 designates an air cleaner, a numeral 2 designates a hot wire type air flow sensor, a numeral 3 indicates an intake air temperature sensor for detecting the temperature of sucked air, a numeral 4 represents a throttle valve disposed in an air intake pipe to there-by control an amount of air to be sucked into the engine 16, a numeral 5 a throttle valve opening degree sensor which is connected to the throttle valve 4 to detect a degree of opening of the throttle valve, a numeral 6 a surge tank, a numeral 7 a bypass air quantity adjusting valve disposed in an air passage 14 which bypasses the upstream side and the downstream side of the throttle valve 4, a numeral 8 an intake manifold, a numeral 9 a water temperature sensor attached to a cooling water passage in which cooling water for cooling the engine 16 flows, a numeral 10 an injector attached to each cylinder, a numeral 11 an air intake valve driven by a cam (not shown), a numeral 12 a cylinder, a numeral 13 a crank angle sensor for detecting a crank angle and the revolution speed of the engine 16 and a numeral 15 an electronic control unit (ECU).

The operation of the conventional fuel control device will be described.

The ECU 15 calculates a fuel supply quantity to the engine on the basis of an intake air quantity detected by the air flow sensor 2, a crank angle signal generated from the crank angle sensor 13 and a cooling water temperature detected by the water temperature sensor 9, and controls the injector 10 to inject fuel in synchronism with the crank angle signal. The outputs of the intake air temperature sensor 3 and the throttle valve opening degree sensor 5 are used-as auxiliary parameters. The ECU 15 also controls the bypass air quantity adjusting valve 7. However, the details of the operation concerning the control of the adjusting valve 7 are omitted.

The calculation of the intake air quantity by the ECU is conducted in such a manner that the intake air quantity Q detected by the air flow sensor 2 is sampled at constant time intervals and the mean value $Q_A$ of the sampled intake air quantities is obtained in synchronism with a leading edge (or trailling edge), for instance, a point B, of a crank angle signal. In other words, the mean value $Q_A$ of the intake air quantities is obtained in the period between adjacent leading edges, such as points A and B, of the crank angle. Namely, $$Q_A = \frac{Q1 + Q2 + Q3 + Q4}{4}\Big).$$

Thus, a fuel quantity to the engine was obtained on the basis of the value.

Since the above-mentioned conventional apparatus operates to calculate the fuel quantity to the engine on the basis of the mean value of intake air quantities sampled between given crank angles, the period of a crank angle signal becomes short when the engine is operated at a high revolution speed as shown in FIG. 3. This results in the reduction of the number of samplings of the intake air quantity. Accordingly, even when each intake air quantity to the engine is constant at a steady state, an intake air quantity $Q_{AD}$ calculated at a point D and an intake air quantity $Q_{AE}$ calculated at a point E respectively have values $Q_{10}/1$ and $Q_{20}/1$; thus the values $Q_{AD}$ and $Q_{AE}$ are different from the actual intake air quantity. This is because the number of samplings is too small with respect to a crank angle period. In order to assure a sufficient number of samplings, it can be considered that a period of calculating a crank angle should be 2 or 3 times as long as the crank angle signal period. In this case, however, there is a problem of poor response because the number of samplings is too great when the engine is operated at a low revolution speed.

SUMMARY OF THE INVENTION

It is an object of the present invention to provide a fuel control apparatus for an internal combustion engine capable of calculating correctly and quickly the intake air quantity in a range from a low revolution speed to a high revolution speed of the engine and capable of controlling the fuel injection with reliability.

The foregoing and other objects of the present invention have been attained by providing a fuel control apparatus for an internal combustion engine which comprises an intake air quantity detecting means for detecting an intake air quantity for the engine, a crank angle detecting means for detecting a crank angle of the engine, a sampling means for sampling the intake air quantity every predetermined time, a first calculating means for calculating the mean value of the sampled values every predetermined crank angle, a switching means for changing the crank angle value in accordance with the revolution speed of the engine, a second calculating means for calculating a fuel injection quantity on the basis of the calculated mean value, and a fuel injection means for injecting fuel to the engine at the fuel injection quantity obtained by the calculation.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENT

Figure 1:
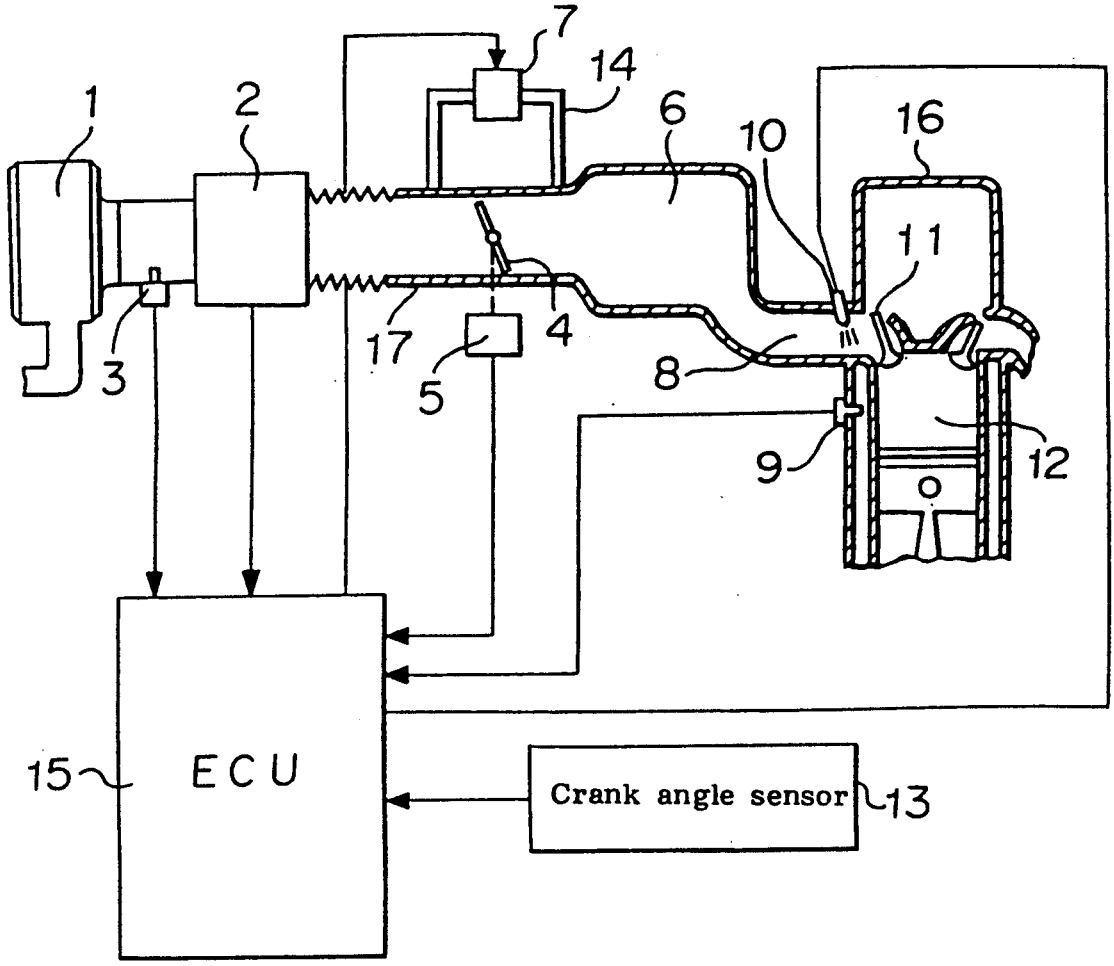
FIG. 1 is a block diagram of an electronic control apparatus for an internal combustion engine, which is the same in construction as the apparatus according to the present invention.
Figure 2:
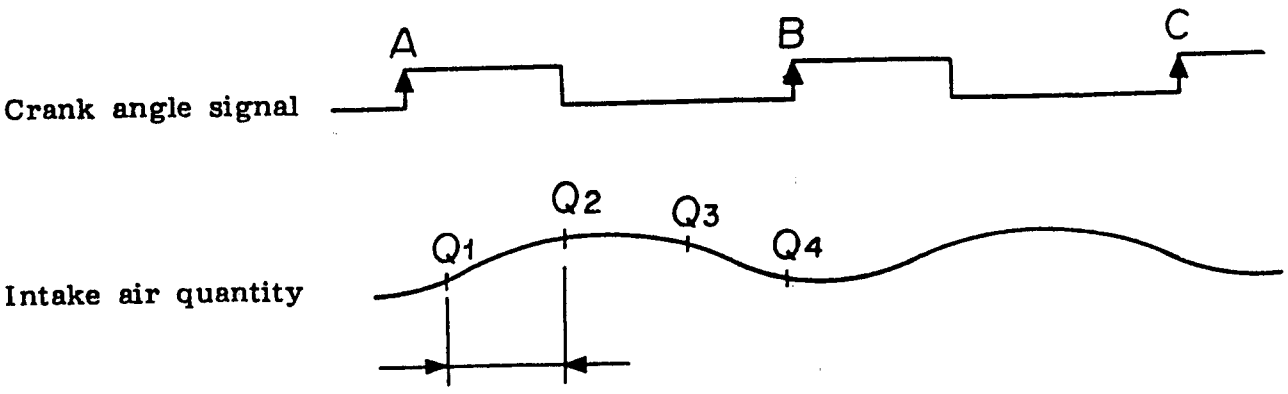
FIG. 2 is a diagram showing the operation of a conventional fuel control apparatus.
Figure 3:
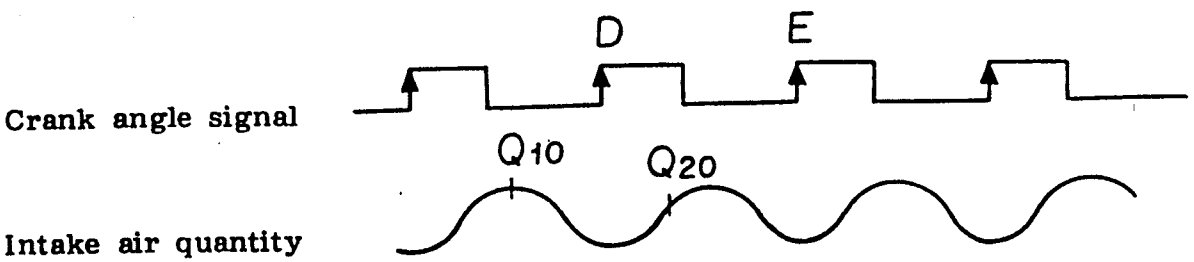
FIG. 3 is an operational diagram showing a problem of the conventional apparatus.

A preferred embodiment of the fuel control apparatus of the present invention will be described with reference to the drawings. The construction of an embodiment of the fuel control apparatus of the present invention is the same as that shown in FIG. 1.

Figure 4:
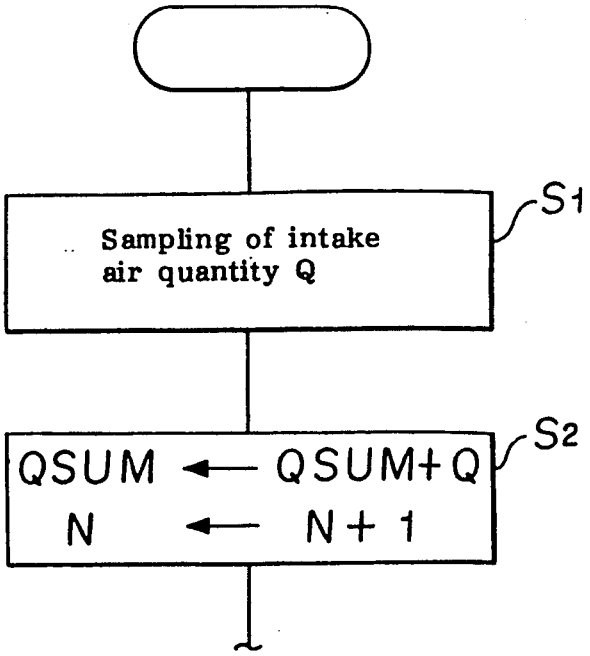
FIGS. 4 and 5 are respectively flow charts showing the operation of an embodiment of the fuel control apparatus of the present invention.

In a flow chart showing sampling operations executed at constant time intervals, as shown in FIG. 4, it is desired that the period of sampling is shorter than the smallest period which can be considered as one period of the crank angle signal.

At step S1, an intake air quantity Q is obtained from the output of the air flow sensor 2. At step S2, the sampled intake air quantity Q is added to an integrated value $Q_{SUM}$ and the value N counted by the counter is set to N+1. Thus the treatment is finished.

Figure 5:
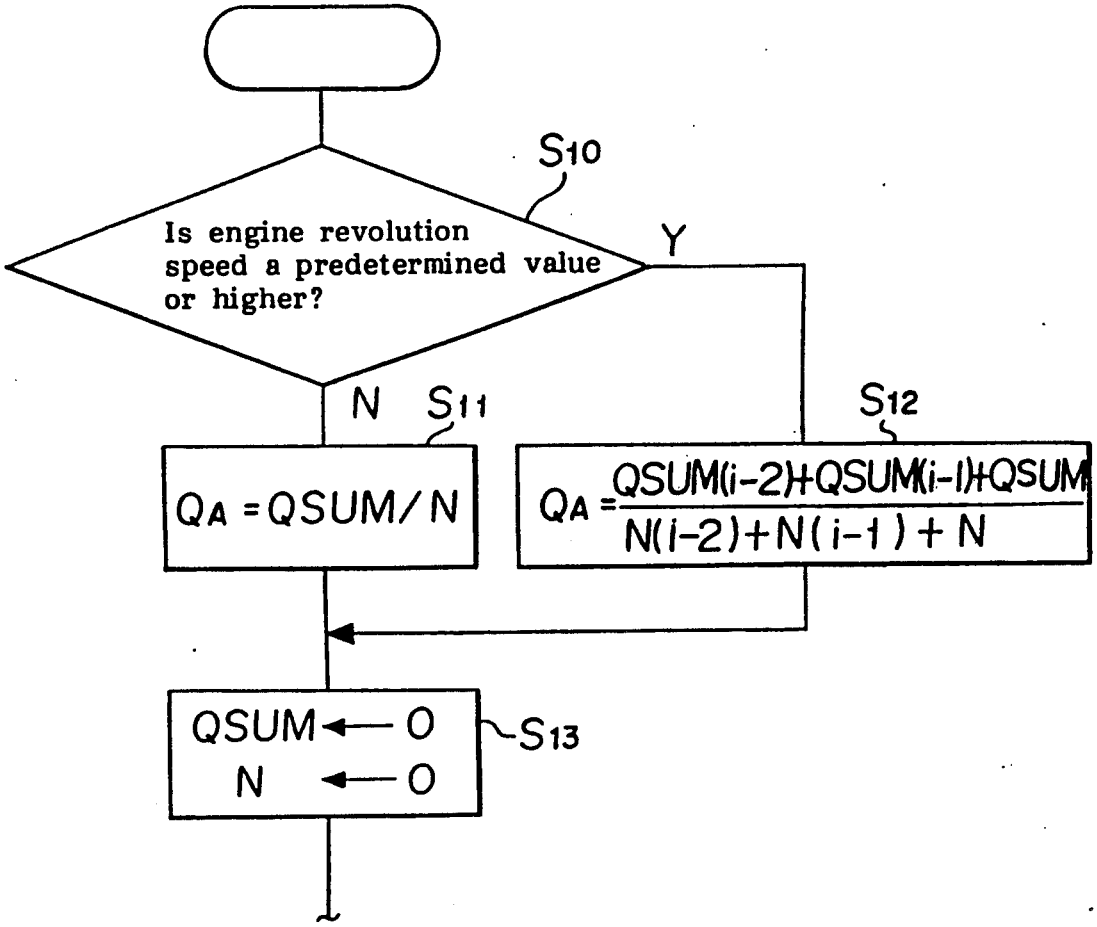

FIG. 5 is a flow chart to average intake air quantities to be conducted in synchronism with leading edges or trailing edges of the crank angle signal.

At Step S10, a determination is made as to whether or not the engine revolution speed is at a predetermined value or higher. When the engine revolution speed is lower than the predetermined value, i.e. the crank angle period is sufficiently long, the sequence goes to step S11 at which a mean value $Q_A$ of intake air quantity is obtained by dividing the integrated value of intake air quantity $Q_{SUM}$ by the number of samplings N in one crank angle period.

When the engine revolution speed is in a predetermined value or higher, i.e. in this case, one period of the crank angle signal is short, the sequence goes to step S12. At step S12, the number of samplings N in one period at the present time of the crank angle signal, the number of samplings N (i−1) in one period at the last time and the number of samplings N (i−2) in one period before the last are summed. On the other hand, the integrated values of intake air quantity $Q_{SUM}$, $Q_{SUM}$ (i−1) and $Q_{SUM}$ (i−2) in the above-mentioned crank angle periods are summed. Then, a mean value of intake air quantity is obtained by dividing the value obtained by summing the integrated values of intake air quanitity by the value obtained by summing the numbers of sampling.

At step S13, both the integrated value $Q_{SUM}$ and the counted value N are cleared to Zero, and the sequence goes to the next step.

In the above-mentioned embodiment, since the crank angle period is long when the engine revolution speed is low, intake air quantities sampled in one crank angle period are averaged. On the other hand, when the engine revolution speed is high, i.e. the crank angle period is short, an average treatment of intake air quantities is conducted over 3 crank angle periods. Accordingly, the advantages of poor response at a low revolution speed of the engine and an incorrect information on intake air quantity at a high revolution speed of the engine can be avoided.

In the above-mentioned embodiment, a single predetermined value is used with respect to engine revolution and judgement to average the intake air quantities is conducted once depending on whether an engine revolution speed is higher or lower than the predetermined value. However, a plurality of predetermined values may be used by grading them so that a plurality of times of judgement may be applied. Further, the crank angle period can also be changed depending on the system used. Further, it is also possible to average the intake air quantities irrespective of the crank angle period.

Thus, accordance with the present invention, the crank angle is changed depending on the engine revolution speed and a mean value of sampled intake air quantities is caluculated according to the condition determined by the engine speed. The crank angle for averaging the intake air quantity is made large when the engine revolution speed is high, and the crank angle is made small when it is low. Accordingly, an appropriate number of sampling can be provided in a range from a low revolution speed to a high revolution speed and calculation of the intake air quantity can be correctly and quickly obtained. Further, the control of fuel can be obtained as well.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel control apparatus for an internal combustion engine which comprises:

an intake air quantity detecting means for detecting an intake air quantity for the engine, a crank angle detecting means for detecting a crank angle of the engine, a sampling means for sampling the intake air quantity at constant, predetermined time intervals, means for determining if the engine speed is at or above a predetermined value, a first calculating means for calculating the mean value of the sampled values during a single crank angle period when the engine speed is below the predetermined value, a second calculating means for calculating the mean value of the sampled values by dividing the sum of accumulated values of the air intake quantity samplings in one crank angle period at the present time and the accumulated values of the air intake quantity samplings in at least one crank angle period of a preceding time, by the sum of the number of samplings at the present time and the number of samplings at the preceding time when the engine speed is at or above the predetermined value, a third calculating means for calculating a fuel injection quantity on the basis of an output from a selected one of the first and second calculating means, and a fuel injection means for injecting fuel to the engine in accordance with the fuel injection quantity calculated by the third calculating means.

* * * * *